United States Patent [19]

Yegge

[11] 4,043,133

[45] Aug. 23, 1977

[54] STRUCTURE AND METHOD OF CONSTRUCTING AND TEST-LOADING PILE ANCHORED FOUNDATIONS

[76] Inventor: Lawrence R. Yegge, 139 Via de Tesoros, Los Gatos, Calif. 95030

[21] Appl. No.: 707,184

[22] Filed: July 21, 1976

[51] Int. Cl.[2] ..... E02D 5/74

[52] U.S. Cl. ..... 61/50; 61/39; 61/56.5; 52/166; 52/169.1

[58] Field of Search ..... 61/39, 35, 50, 53.52, 61/53.5, 56, 56.5, 63, 31; 52/742, 230, 169, 166, 155

[56] References Cited

U.S. PATENT DOCUMENTS

| | | | |
|---|---|---|---|
| 2,763,464 | 9/1956 | Leonhardt | 52/230 X |
| 3,087,308 | 4/1963 | Hart et al. | 61/50 X |
| 3,256,694 | 6/1966 | Siedenhans | 61/50 |
| 3,299,644 | 1/1967 | White | 61/39 X |

FOREIGN PATENT DOCUMENTS

| | | | |
|---|---|---|---|
| 683,898 | 4/1964 | Canada | 61/39 |

*Primary Examiner*—Jacob Shapiro
*Attorney, Agent, or Firm*—Naylor, Neal & Uilkema

[57] ABSTRACT

A method of constructing pre-tested concrete pilings and pile caps particularly for use in supporting structures, such as transmission line towers that are subjected to large overturning moments. One or more pile holes are bored, a small diameter sheathing containing one or more steel tendons is inserted and a concrete mixture is poured in the pile hole exterior of the tendon sheathing with the tendons anchored in the bottom of the pile. When the concrete has obtained sufficient strength, the tendon is stressed, thereby testing the tension-carrying capacity of the pile and its surrounding foundation soil. A concrete pile cap is thereafter joined to the pile, the tendons are again stressed and anchored to the pile cap and the tendon sheathing is filled with concrete grout to form a solid post-tensioned foundation that has been pre-tested at a force in excess of its design load.

7 Claims, 8 Drawing Figures

STRUCTURE AND METHOD OF CONSTRUCTING AND TEST-LOADING PILE ANCHORED FOUNDATIONS

BACKGROUND OF THE INVENTION

This invention relates to the construction of concrete piling and more particularly to a method of constructing, on the site, a structure foundation which includes one or more concrete piles post-stressed to the pile cap to form a rigid unitary foundation for a structure, such as an electrical transmission line tower, that may be subjected to severe overturning moments or uplifting forces as well as the downward gravity loads. The invention is particularly valuable for use in the construction of transmission line towers in remote areas where all construction material may be transported to the site by helicopters, thereby obviating the need for costly access roads.

SUMMARY OF THE INVENTION

Briefly described, the invention includes the steps of boring a pile hole to the appropriate design depth, inserting one or more steel cable tendons loosely contained in and extending from, the ends of a tubular metal tendon sheath running coaxially through the length of the bored hole, and then pouring a concrete mixture in the hold within one or two feet of the ground surface, but not within the tendon sheath, so that the lower end of the tendon is firmly anchored in the bottom of the concrete pile but is loose within the tendon sheath. When the concrete has attained sufficient compressive strength, the tendon is stressed to approximately 125% of the design load of the pile to test the tension capacity of the pile and its surrounding soil. The upward force applied to the pile by means of the stressing tendon has its reaction against the temporary jacking pad, which pad is separated from the pile in such a way that no part of the reaction to the applied force is taken at the top of the pile. Since it is known that a pile's resistance to a downward load is at least equal to (and normally greater than) its capacity to resist uplift, the minimum value at which the pile will support downward loads is established by the performance of the pile under the uplift load applied. Thereafter, the tendon is de-tensioned, a pile cap is poured to connect with the pile top, the tendon is again stressed to the design load, the tendon is anchored to the pile cap, and cement grout is then pumped into the tendon sheathing to form a solid unitary pre-tested pile and cap.

BRIEF DESCRIPTION OF THE DRAWINGS

In the drawings that illustrate the preferred embodiment of the invention.

DESCRIPTION OF THE ILLUSTRATED EMBODIMENT

Figure 1:
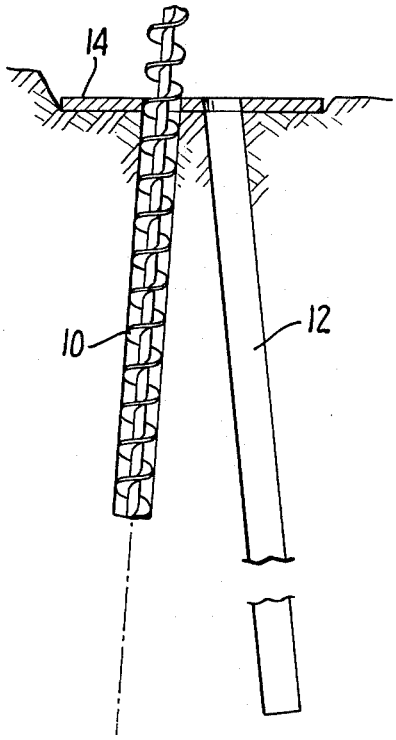
FIG. 1 is a profile view illustrating the boring, through a template, of two diverging pile holes.

Turning now to a detailed description of the invention, FIG. 1 is a sectional elevation view illustrating the boring of two diverging pile holes 10 and 12. Prior to this boring operation, the ground surface has been excavated to a footing or beam line and a boring template 14 has been installed. Pile holes 10 and 12 may, in most cases, have a diameter of only twelve to fourteen inches and their depth will, of course, be dependent upon the consistency and nature of the subsoil and the various design loading on the structure.

Figure 2:
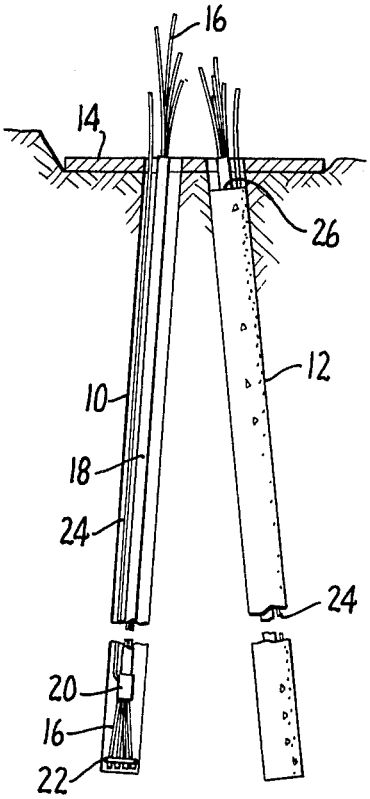
FIG. 2 is a profile view illustrating the placement of the tendons and the tendon sheath.

In FIG. 2, piling holes 10 and 12 have been completely bored to the design depth. Inserted throughout the length of hole 10 and extending above the ground surface are one or more steel tendons 16. Tendons 16 are loosely encased in a tendon sheathing 18, which preferably is a galvanized steel conduit that may be spirally wound to reduce wobble within the piling holes. The lower end of sheathing 18 is provided with a collar 20 from which the tendons 16 extend to be spread and anchored to an anchor plate 22. As will be subsequently explained in detail, a plastic grout tube 24 enters the sheathing collar 20 and extends up through the piling hole and through the boring template 14 where it remains above ground surface for a future step in the construction process.

Upon installation of the tendons 16 and the tendon sheathing 18, concrete is poured into that portion of the piling hold outside of the sheathing 18 and up to a level 26 approximately one foot below the bottom surface of template 14. As will be explained in connection with FIG. 7, a mastic is packed in the lower end of collar 20 to prevent the poured concrete from seeping around the tendons 16 and into the tendon sheathing 18.

Figure 3:
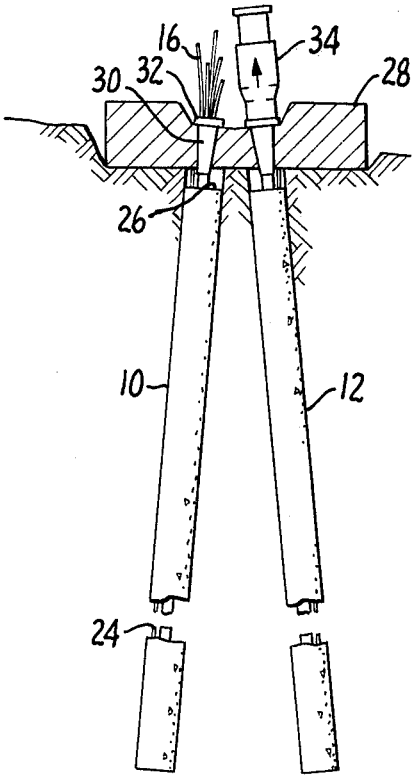
FIG. 3 is a profile view illustrating the placement of a jacking pad and tendon jack.

After the concrete has attained a sufficient compressive strength, the drilling template 14 is removed and is replaced with a temporary jacking pad 28, as illustrated in FIG. 3. Jacking pad 28 is a large surfaced steel or concrete structure suitably bored to receive the tendons 16, an anchorage trumpet 30 and a bearing plate 32. Jacking pad 28 is provided with two upper surfaces that are pitched at an angle normal to the longitudinal axes of piling holes 10 and 12 to receive a tensioning jack 34. The illustrated jack 34 is of the type disclosed in my U.S. Pat. No. 3,597,830.

As will be discussed in detail in connection with FIG. 8, the tensioning jack 34 is connected to the end of each tendon 16 and the tendons are stressed to 125% of the design load of the pile. By stressing the tendons in this manner, the tension capacity of the pile and its surrounding soil is tested to assure that uplift forces will not dislodge the pile. Likewise, the compressive load-carrying capacity of the pile is also tested as this capacity is at least as great as the tension capacity. Furthermore, the force exerted by the bottom of the jacking pad 28 can be used when desired to effectively test the vertical downward load-carrying capacity of the sub-surface soil. Since there is a space of approximately one foot between the top level 26 of the poured pile and the bottom surface of the jacking pad 28, sub-surface soil consolidation may be achieved by continuing the test load until the desired consolidation is obtained. When the test has been completed and any desired soil compaction has been obtained, tendons 16 are de-tensioned and the tensioning jack 34 and the temporary jacking pad 28 are removed.

Figure 4:
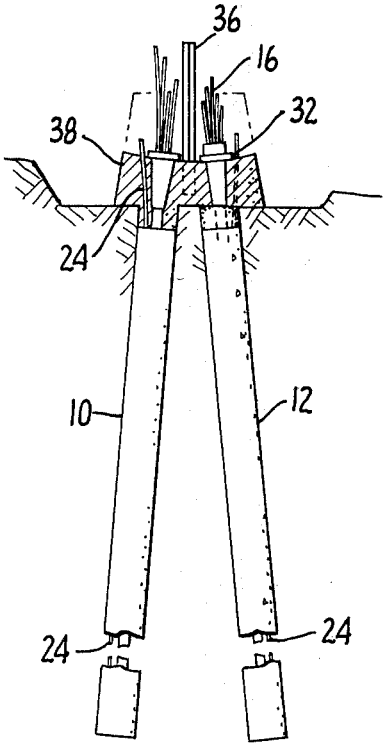
FIG. 4 is a profile view illustrating the pouring and connection of a permanent pile cap.

FIG. 4 is a sectional elevation view illustrating that after removal of the temporary jack pad 28, a concrete form is placed, a bearing plate 32 and trumpet 30 assembly is attached to the top of the tendon sheathing 18, the desired stub angle 36 is installed and the lower portion of the bearing cap 38 is poured from the top of the existing concrete piles and the ground surface to the lower surface of the bearing plate 32.

Figure 5:
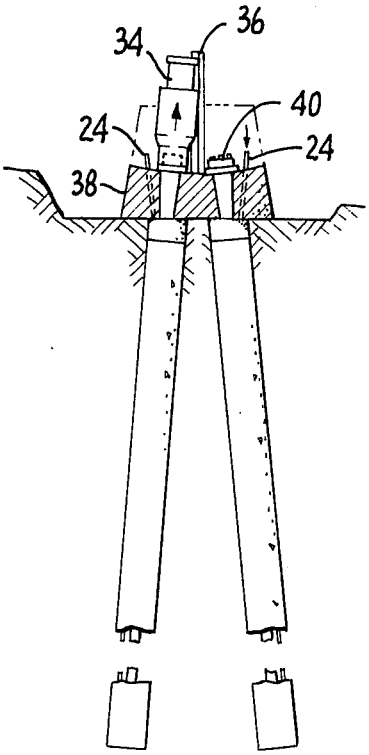
FIG. 5 is a profile view illustrating the post-tensioning of a completed pile to the pile cap.

After the lower portion of the piling cap has attained sufficient strength, the tendons 16 are threaded through a suitable anchor head 40, as illustrated in FIG. 5. The tensioning jack 34 is reinstalled and the tendons 16 are stressed to their design load and permanently anchored to anchor head 40. This post-stressing step renders the pile cap 38 and each of the pilings into a solid unitary structure so that compressive loads applied downward upon the piling cap 38 will be carried by the pilings 10 and 12, as well as by the cap 38.

After tendons 16 have been stressed and anchored to the anchor head 40, a cement grout is pumped through the plastic grouting tube 24 and the interior of the tendon sheathing 18 and anchor head 40 is filled with grout. This grouting prevents corrosion of the steel tendons 16 and further adds to the solidarity of the pilings.

Figure 6:
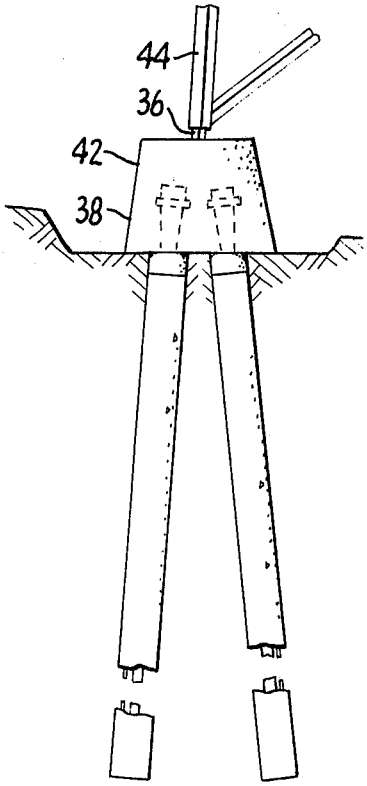
FIG. 6 is a profile illustrating the completed pile cap with installed stub angle.

FIG. 6 illustrates that, upon completion of the post-stressing and anchoring step described above, the piling cap form is again installed and the concrete piling cap is completed by pouring an upper portion 42 that covers the anchor head 40 and the exposed ends of the tensioned tendons 16 which now become thoroughly and permanently anchored. Thereafter, the desired structure 44 may be installed.

Figure 7:
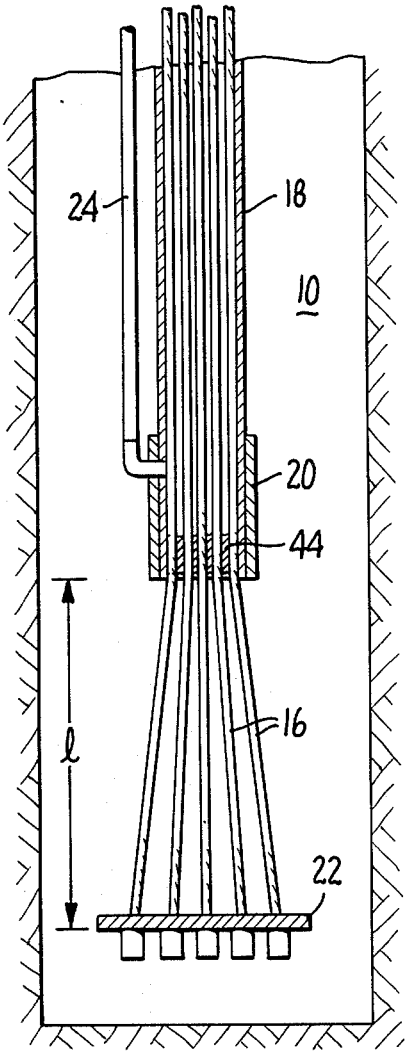
FIG. 7 is a detailed elevation view of the lower end of the tendon sheath with the extending tendons anchored to an anchor plate; and, FIG. 8 is a detailed elevation view of the pile top and illustrates the placement and structure of the tensioning jack.

FIG. 7 illustrates in detail the lower end of the tendon sheathing 18 with the attached collar 20 from which the tendons 16 extend. In most instances it is necessary to anchor the lower ends of the tendons 16 to an anchor plate 22 which effectively separates the ends of the tendons and prevents them from being pulled through the sheathing during the tensioning step described in connection with FIG. 3. It has been found that, if the pile hole is sufficiently deep so that the length of the exposed tendons 16 extending from the collar 20 is five feet or greater, there is adequate anchorage by the tendons themselves and a bottom anchorage plate 22 may be omitted. FIG. 7 also illustrates that tendons 16 are sealed in the lower end of the collar 20 by a mastic seal 44, which is installed prior to inserting the sheathing 18 into the piling hole 20 to prevent the poured concrete of the pile from entering the sheathing 18. After the post-tensioning of the tendons 16, as described in connection with FIG. 5, cement grout is forced through the plastic grouting tube 24 that is connected to the collar 20 and the interior portion of the sheathing 18 is then filled with the cement grout to prevent corrosion of the cable and to add additional strength and rigidity to the sheathing section of the piling.

Figure 8:
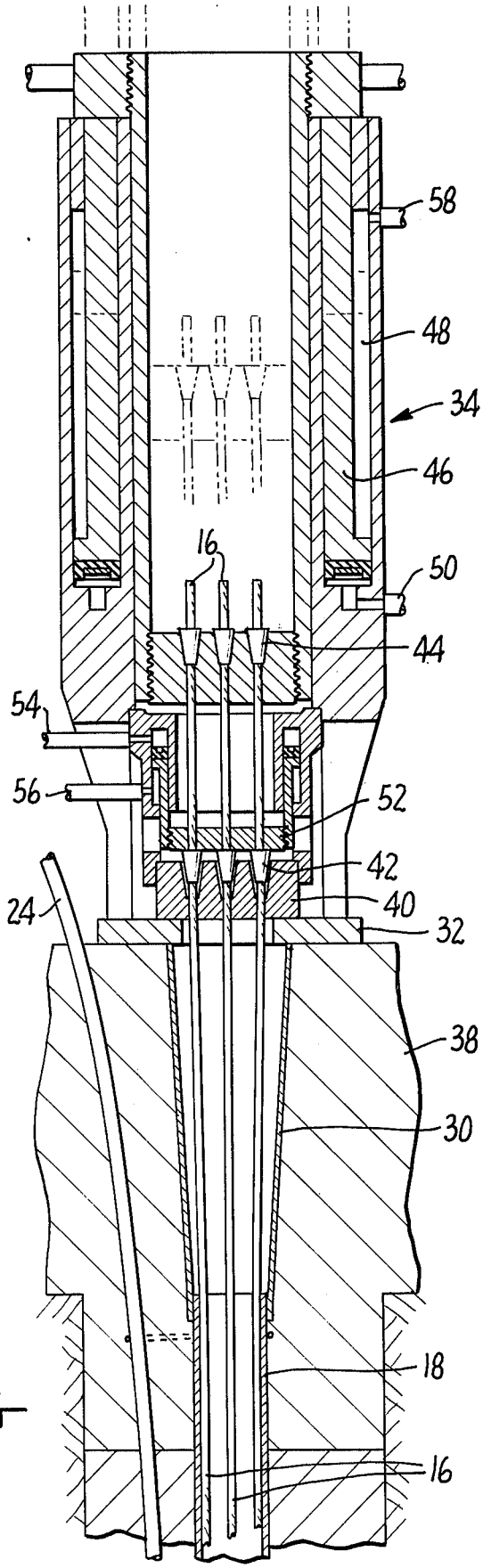

FIG. 8 is a detailed elevation view of the top end of the tendon sheathing 18 connected in a trumpet 30 that is embedded in the lower portion of the pile cap 38. The tensioning jack 34 is installed in its position for the post-tensioning operation described in connection with FIG. 5. As shown in FIG. 8, the tendons 16 extend through the trumpet 30 and the bearing plate 32, which overlies both the trumpet 30 and the top surface of the pile cap 38. Atop the upper surface of bearing plate 32 is anchor head 40, which is a thick steel disc drilled to receive tendons 16. The tendon holes on the top surface of anchor head 40 are conically counterbored to receive gripper jaws 42.

Tensioning jack 34 is installed on the bearing plate 32 and is aligned with the anchor head 40 so that tendons 16 extend through the center open portion of jack 34 where they are anchored by a second set of gripper jaws 44 connected to a hydraulic piston assembly in the tensioning jack 34. This piston assembly includes an annular piston 46 adapted to slide within an annular cylinder 48 coaxially located in the housing of the jack 34. An intake port 50 admits an hydraulic fluid under force into the cylinder area, forcing the annular piston 46 to apply tension to the tendons 16. Installed within tensioning jack 34 and adjacent the anchor head 40 is a second piston 52 which, when activated by the application of pressure through intake port 54, will apply a downward locking force against gripper jaws 42 to insure that the jaws lock tendons 16. When presure is applied to the intake port 56 of the piston 52, the piston releases its force against the gripper jaws 42. This releasing function is necessary when it is desired to detension tendons 16 as described in connection with FIG. 3. When it is desired to remove tensioning jack 34 after tendons 16 have been tensioned, pressure is admitted to intake port 54, forcing piston 52 to lock the gripper jaws 42. Pressure is then admitted to the intake port 58 to force the main tensioning piston 46 back down to its non-tensioning position. At this point, the gripper jaws 44 are loose and may be removed so that the entire tensioning jack 34 may be lifted from the bearing plate 32, thereby leaving the tendons 16 firmly anchored in the gripper jaws 42 of the anchor head 40.

CONCLUSION

Although a preferred embodiment has been illustrated and described, it should be understood that the invention is not limited to the specifics of this embodiment, but rather is defined by the following claims. For example, it is possible that the separate jacking pads illustrated in FIG. 3 might be omitted and that a pile cap with voids between the cap and the piles might be employed for use in the load-testing step. In such an arrangement, the voids between the cap and piles would be filled after load testing and prior to the final stressing step.

What is claimed is:

1. A method of making a pre-tested anchored foundation structure in which the anchor members carry compressive loads and resist upward loads including the steps of:

boring at least one pile hole into the sub-surface soil;

inserting into each pile hole a sheath containing one or more tendons, said tendons extending from the lower end of said sheath into the bottom end of said pile hole, and extending from the top end of said sheath above the surface of the soil;

forming a pile by pouring a concrete mixture into said hole to the exterior of said sheath, whereby the tendons extending from the lower end of said sheath become anchored to the bottom end of said pile but remain free for movement within said sheath;

mounting a tensioning jack to a jacking pad supported on the soil surface out of bearing engagement with the pile to position the jack in spaced relationship above the top of said pile, and connecting said jack to said tendons extending from the top end of said sheath; and actuating said tensioning jack to apply a tension to said tendons, whereby said pile and its surrounding soil is pre-tested to withstand a measured force thus applied, and whereby the soil beneath the bottom surface of said jacking pad is loaded.

2. The method claimed in claim 1 further including the steps of;

de-tensioning said tensioning jack and removing said jack and said jacking pad;

forming and pouring a permanent concrete pile cap above and connected to the tops of said concrete piles;

re-installing a tensioning jack to the surface of said pile cap and attaching said jack to said extending tendons; and actuating said jack to apply tension to said tendons, whereby said pilings and said pile cap are compressed into a unitary member.

3. The method claimed in claim 2 further including the step of permanently anchoring said stressed tendons to said pile cap, and removing said tensioning jack.

4. The method claimed in claim 3 further including the step of pumping cement grout into said sheath extending throughout the center of each of said pilings.

5. The method claimed in Claim 4 further including the step of forming and pouring a top concrete section to said pile cap for sealing said anchored tendons within said pile cap.

6. The method claimed in claim 2 further including the step of installing a stub angle during said step of forming and pouring a permanent concrete pile cap.

7. The method claimed in claim 1 wherein at least two diverging holes are bored into the sub-surface soil.

* * * * *